US008584566B2

(12) United States Patent
Pienta et al.

(10) Patent No.: US 8,584,566 B2
(45) Date of Patent: Nov. 19, 2013

(54) AUTOMATIC CORE CLEANING APPARATUS

(75) Inventors: Daniel J. Pienta, Lambertville, MI (US); David M. Pienta, Lambertville, MI (US)

(73) Assignee: Automatic Handling Intl., Erie, MI (US)

( * ) Notice: Subject to any disclaimer, the term of this patent is extended or adjusted under 35 U.S.C. 154(b) by 385 days.

(21) Appl. No.: 12/928,231

(22) Filed: Dec. 7, 2010

(65) Prior Publication Data

US 2012/0137462 A1 Jun. 7, 2012

(51) Int. Cl.
*B26D 1/18* (2006.01)

(52) U.S. Cl.
USPC ..... 83/614; 83/649; 83/924

(58) Field of Classification Search
USPC ..... 83/614, 649, 924
See application file for complete search history.

(56) References Cited

U.S. PATENT DOCUMENTS

| | | | | |
|---|---|---|---|---|
| 4,158,417 | A * | 6/1979 | Inoue | 414/412 |
| 4,298,173 | A | 11/1981 | Johansson | |
| 4,779,498 | A * | 10/1988 | Perkins | 83/18 |
| 5,467,676 | A * | 11/1995 | Hooper et al. | 83/24 |
| 7,717,147 | B2 | 5/2010 | Milton | |
| 2005/0211040 | A1 * | 9/2005 | Bilskie et al. | 83/485 |

* cited by examiner

*Primary Examiner* — Stephen Choi
(74) *Attorney, Agent, or Firm* — Emch, Schaffer, Schaub & Porcello, Co., LPA

(57) ABSTRACT

An apparatus for automatically removing webbing remnants from unwound cores without damaging the surfaces or ends of the cores. The core cleaning apparatus includes a frame that carries an overhead bridge crane and a cutter frame supporting a movable cutting blade. The overhead crane includes a pair of opposed plugs designed to engage the open ends of the spent core. The cutter frame includes a cutter assembly that has automatically driven horizontally the length of the material webbing of the spent core, thereby cutting excess material webbing from the spent core. The entire operation is managed by a programmable controller without operator intervention.

16 Claims, 10 Drawing Sheets

AUTOMATIC CORE CLEANING APPARATUS

TECHNICAL FIELD

The present invention relates generally to an apparatus for cleaning the cores of rolls of sheet form material. After the sheet form material is unwound from the core, remaining scrap sheet form material is removed and the used core is inspected. Good cores are returned to be re-used and rejected cores are disposed of.

BACKGROUND OF THE INVENTION

Many products are manufactured from elongated sheet or stock material that is shipped and stored in the form of a roll or coil. Continuous strips or webs of thin, flexible material are commonly provided wound on cores to provide rolls of sheet material. The rolls of sheet material are subsequently unwound for production of items made from the materials. Examples of these materials are plastic film, metal foil, tissue and paper.

During the manufacture of products using the sheet material, the sheet or stock material is unwound from the core. If the outer surface of the roll of sheet material is damaged or unusable, the outer surface of material must be removed to expose fresh new material. After the sheet material is unwound, remnants of material remain on the cores of the rolls. In order to properly recycle and use the cores, the remnants of material must be cleaned off the core and the core must be inspected for any damage which would make the core unusable.

Such cores are valuable, particularly, if they can be recycled or reused. In paper product manufacturing, it is commonplace for there to be a large number and variety of cores containing various types of sheet materials. If the cores were to be disposed of instead of recycled, they would create costly, both economically and environmentally, waste. Thus, the sheet material manufacturing industry is searching for a way to quickly and inexpensively clean and recycle used cores.

One common methodology employs operators, located at a core cleaning station or at the end of the manufacturing line yielding a sharp cutting blade to cut the remaining sheet material from the core. This practice is unacceptable on multiple levels. If care is not used, the sharp cutting blades will score the surface of the core, turning it into scrap. Further, there have been numerous incidents of operators injuring themselves and others with the sharp cutting blades.

Another solution is provided in U.S. Pat. No. 4,298,173. The '173 patent discloses an apparatus for unwinding a material web wherein the leading edge of the web is grabbed by nip rollers which serve to unwind the remaining web from the core as the core is being rotated. The remaining web is then disposed of for further processing and the core is sent to a core storage area. It has been observed that apparatus such as that shown in the '173 patent demand continuous operator interface to ensure the remaining material web is successfully removed from the core.

Another proposed solution for the cleaning of cores of rolls of material is provided in U.S. Pat. No. 7,717,147. The '147 provides an apparatus having a stripper means comprising rollers for rotating the cores and nip rollers for catching a free end of the remaining material on each used core and a pull means for pulling the remaining material off each used core. The apparatus further includes a cleaning means for cleaning the used cores after it has been treated by the stripping means and an adhesive applicator for applying adhesive to the used cores whereby the used cores are then ready for reuse as refurbished cores for new rolls of material. The '147 apparatus suffers from the same deficiency as the '173 apparatus in that it requires operator interface to ensure that the remaining material is freely and clearly cleaned off each used core.

The present invention provides an apparatus for the robotic and automatic cleaning of used cores.

SUMMARY OF THE INVENTION

The present invention provides an apparatus for automatically removing stock remnants from unwound cores without damaging the surfaces or ends of the cores, thus providing used cores capable of reuse. The core cleaning apparatus includes a frame that carries an overhead bridge crane and a cutter frame supporting a movable cutting blade. The overhead crane includes a pair of opposed plugs designed to engage the open ends of a spent core or core roll. The opposed plugs are carried by clamp arms that are supported on a spreader bar. The clamp arms move horizontally on the spreader bar thus moving the plug members into and out of engagement with the open ends of the cores. The horizontal movement on the spreader bar allows for the apparatus to adapt to cores of varying lengths.

The spreader bar is carried by a pair of lifting tubes designed to provide vertical movement to the plug members. Thus, the plug members can be lowered to engage a spent core or core roll and lift the core roll or spent core thus allowing it to freely turn. The lifting tubes are carried by a bridge crane that is designed to travel across the top of the apparatus frame on linear rails.

The cutter frame includes a cross brace carrying a cutter assembly. The cutter assembly is automatically driven horizontally the length of the cross brace. The cutter assembly includes a pair of rotationally driven cutter blades separated by a slide plate.

In operation, the spent core or core remnant is carried by the overhead crane toward the cutter assembly. As the cutter assembly engages the surface of the remaining web material, the slide plate forces the material into the cutter blades thus providing a slice across the remaining web material. After the web material has been sliced across the length of the core, the core is rotated to allow the sliced material to fall to a collection conveyor or bin. The cutter assembly then makes another cut on the surface of the web material. This slicing operation continues until the clamp arms engage electromagnets located on the cutter assembly. The cutting blades and slide plates are then placed into engagement with the web material to provide a final finishing cut. The slide plate is designed to not damage the surface of the core. The removed web material is then transported for recycling.

In operation, the cleaning apparatus of the present invention can remove up to 4" of web material with a given slice. A spent roll usually carries 0 to 7" of remaining web material and a used core roll may contain up to 140" of material.

Other objects and advantages of the present invention will become apparent to those skilled in the art upon a review of the following detailed description of the preferred embodiments and the accompanying drawings.

DETAILED DESCRIPTION OF THE INVENTION

Figure 1:
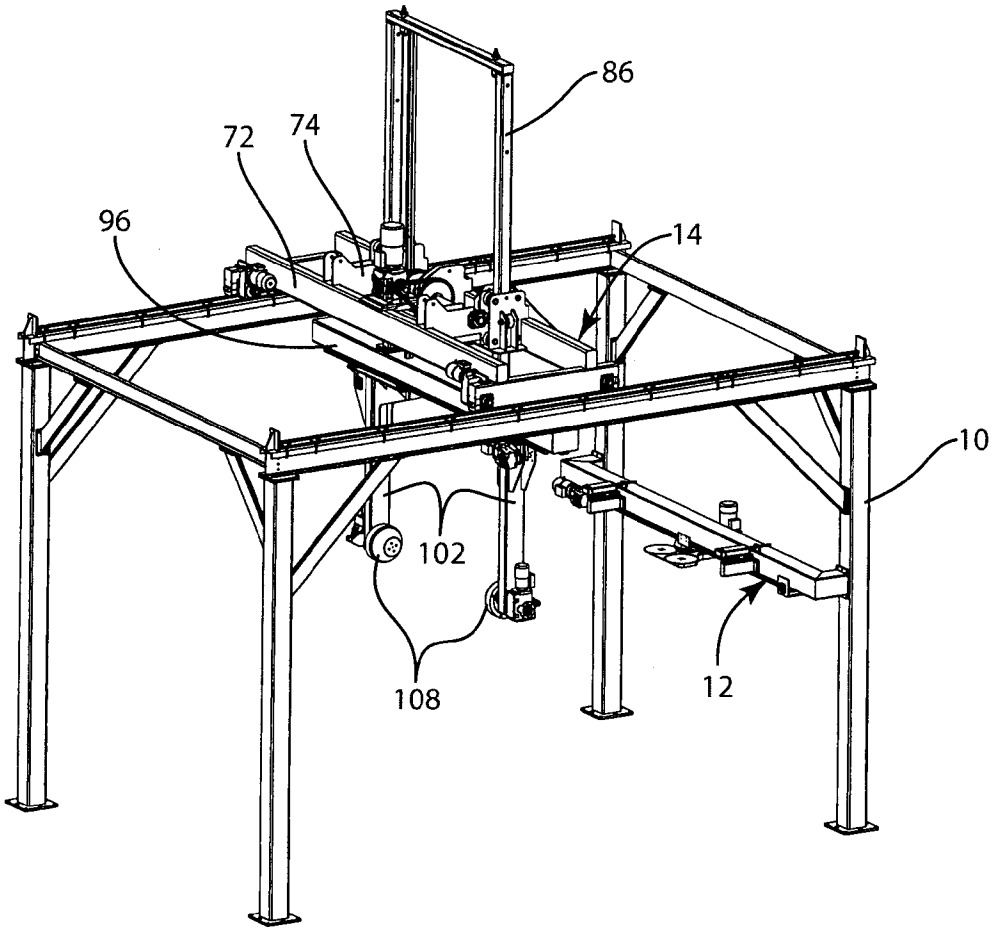
FIG. 1 is a perspective view of the core cleaning apparatus of the present invention.

Referring to FIG. 1, the core cleaning apparatus of the present invention includes a frame 10 carrying a cutter assembly 12 and an overhead crane and plugging assembly 14.

Figure 2:
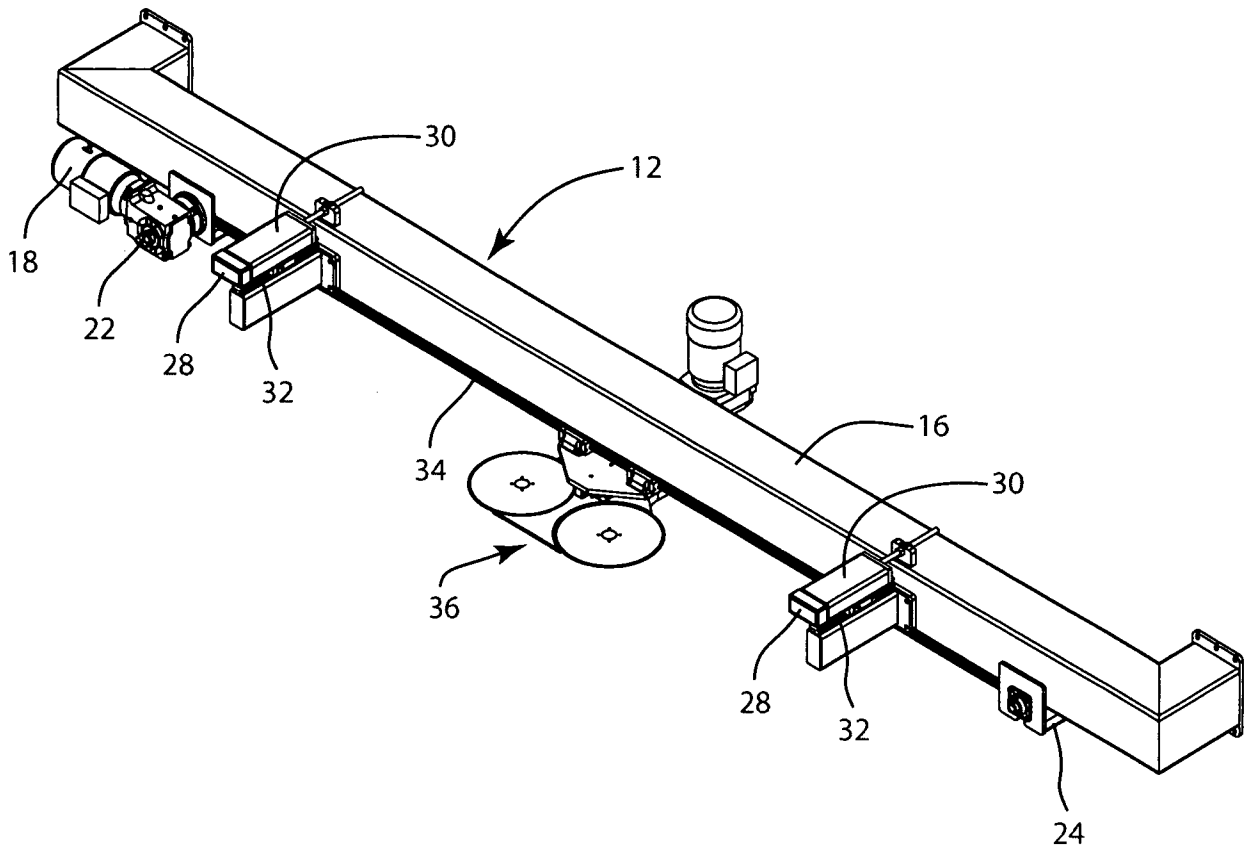
FIG. 2 is a perspective view of the cutter assembly as used with the core cleaning apparatus of the presenting invention.
Figure 3:
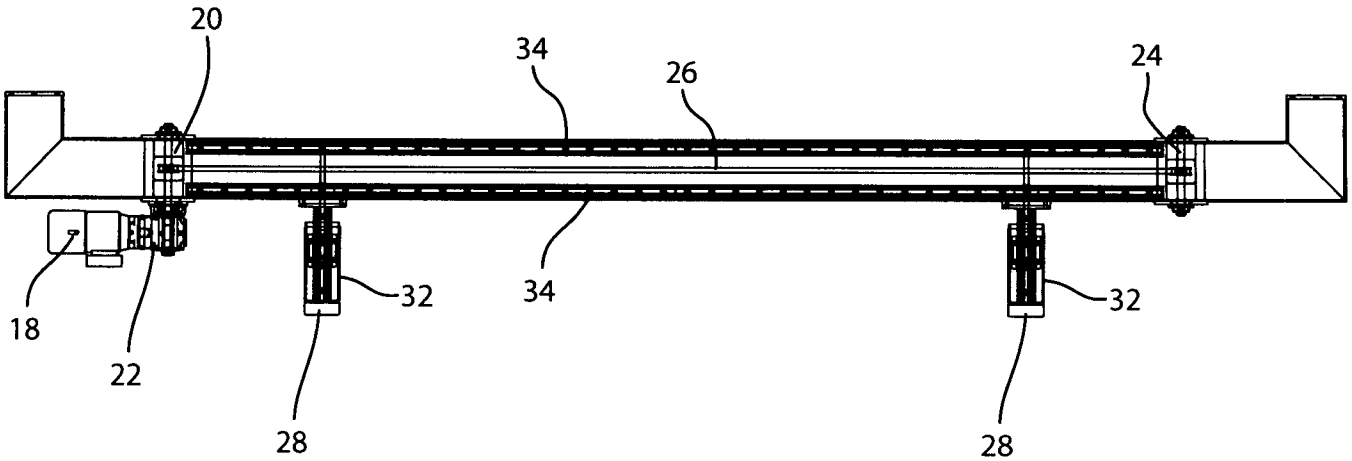
FIG. 3 is a detailed view of the support bar and drive mechanism for the cutter assembly of FIG. 2.

Referring to FIGS. 2 and 3 the cutter assembly 12 includes a slide frame 16 which is mounted on the apparatus frame 10. A drive motor 18 is positioned at one end of the slide frame 16. The drive motor 18 drives drive shaft 20 through sprocket 22. An idler shaft 24 is located at the opposed end of the slide frame 10 and a timing belt 26 is engaged between the idler shaft 24 and the drive shaft 20. The timing belt is positioned underneath the slide frame 16. Opposed electromagnets 28 are positioned on magnet mounts 30 for movement on linear slides 32. Linear slide 34 extends along the bottom edge of the slide frame 16. The linear slide 34 is designed to carry the cutting head 36.

Figure 4:
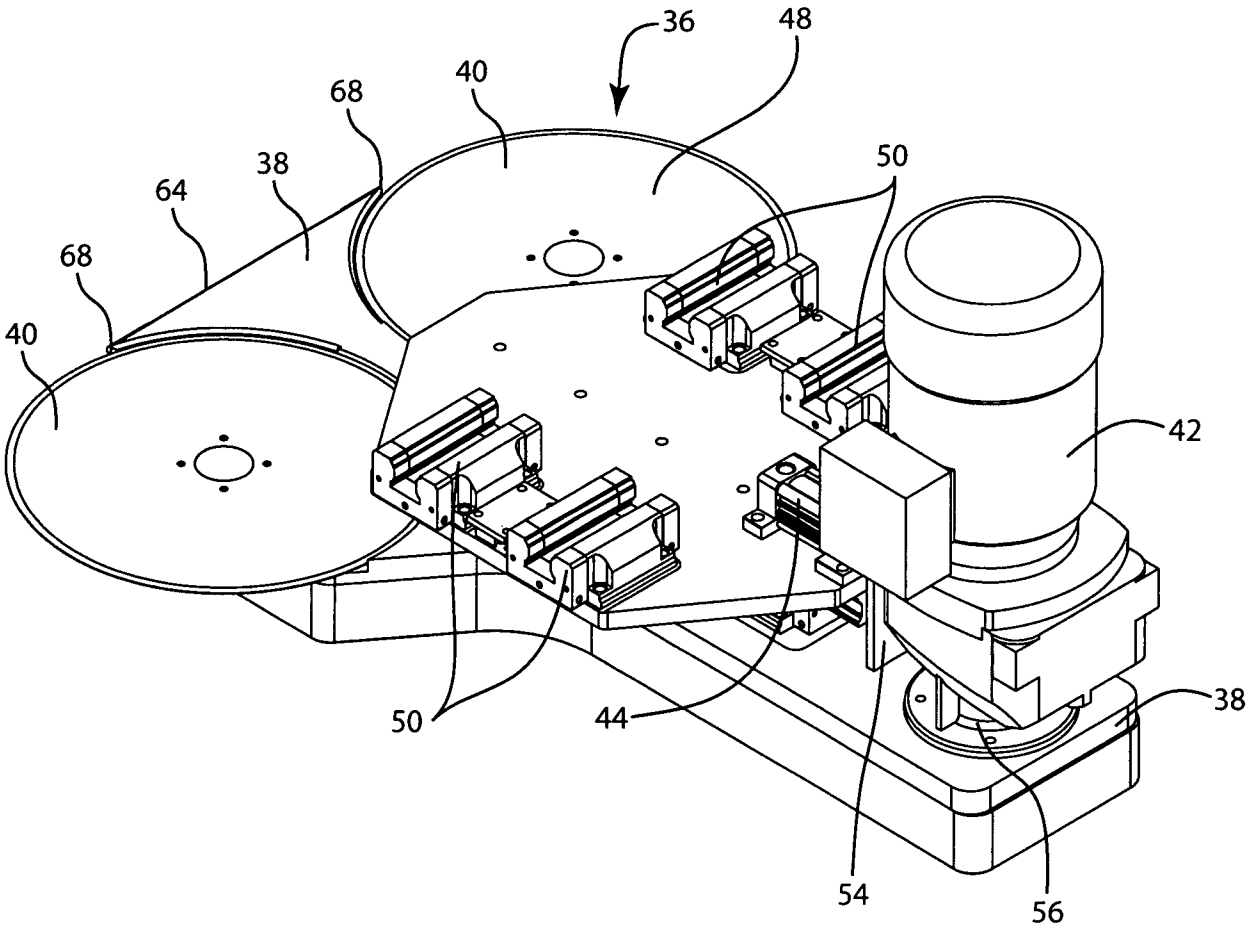
FIG. 4 is a perspective view of the cutting head of the present invention.
Figure 5:
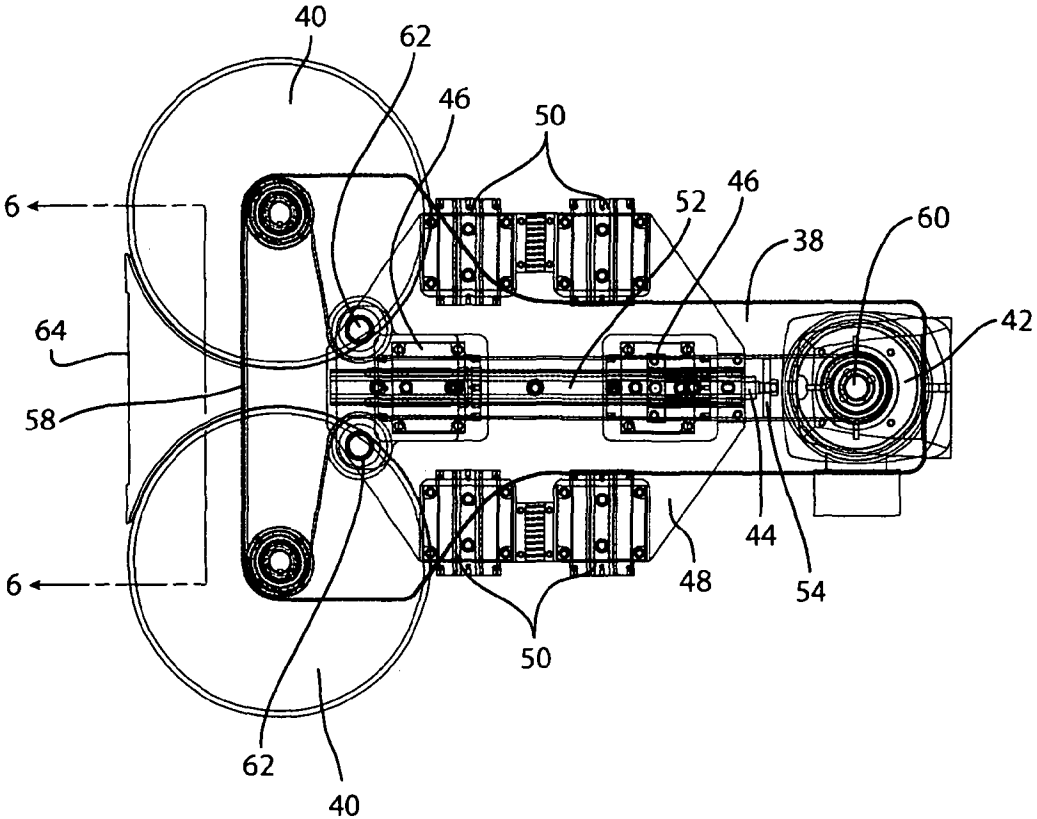
FIG. 5 is a top view of the cutting head of FIG. 4.
Figure 7:
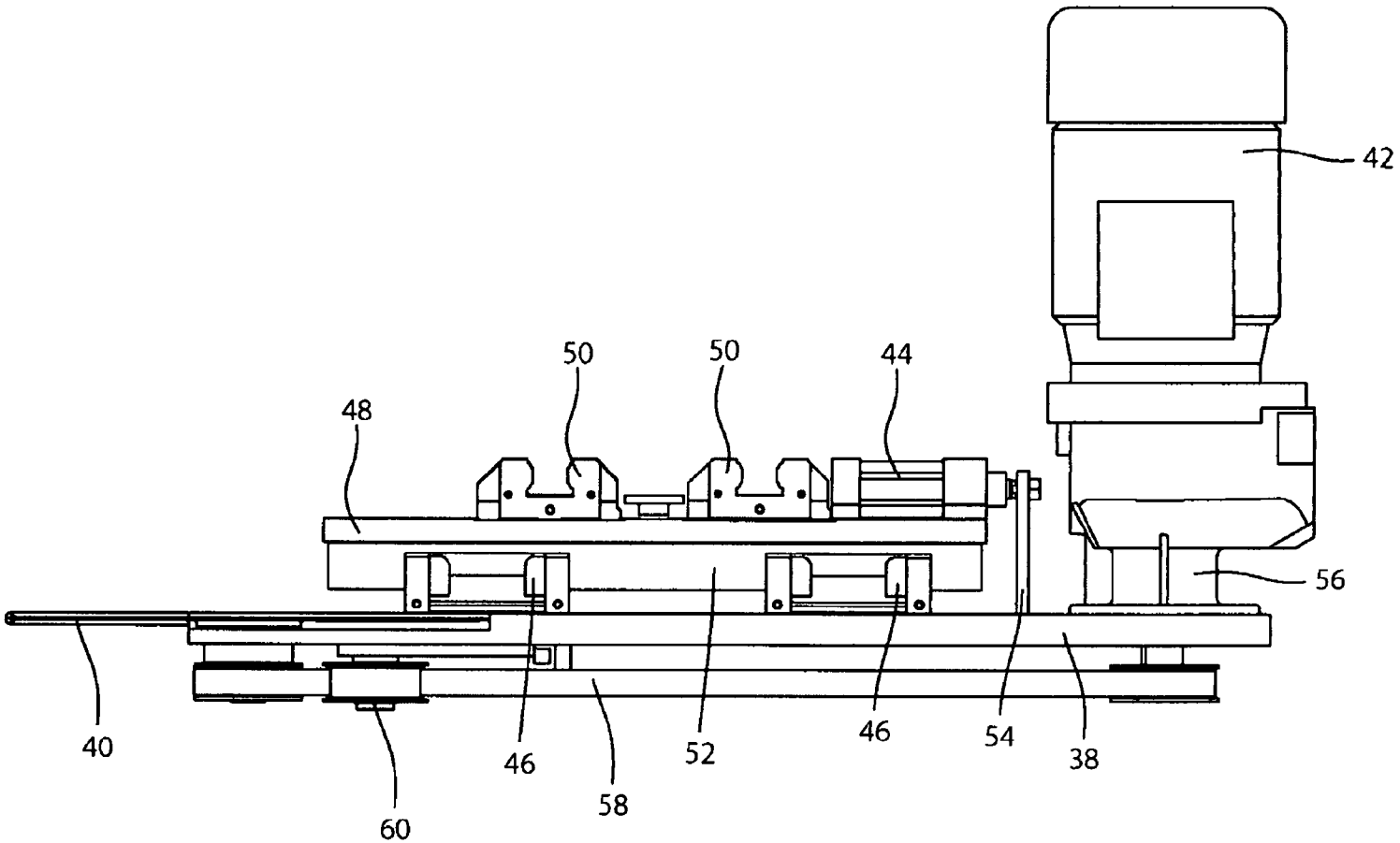
FIG. 7 is a side view of the cutting head of FIG. 4.

Referring now to FIGS. 4, 5 and 7, the cutting head 36 is shown. The cutting head 36 includes a slide plate 38 which carries cutting blades 40, drive motor 42 and, linear slides 46. A carry plate 48 supports pneumatic cylinder 44 and horizontal linear bearings 50. The horizontal linear bearings 50 engage with the linear slide 34 located on the slide frame 16, thus allowing the cutting head 36 to move horizontally on the slide frame 16. The carry plate also supports linear slide 52 which engages with linear bearings 46. The pneumatic cylinder 44 is engaged with anchor 54 which in turn is fixed to the slide plate 38. Movement by pneumatic cylinder 44 against the anchor 54 causes the slide plate 38, cutting blades 40 and drive motor 42 to move in a perpendicular direction to the horizontal slide movement of the carry plate 48. The drive motor 42 engages sprocket 56 which imparts movement to drive belt 58. The drive belt 58 engages and drives the cutting blades 40 through cutting blade drive shafts and pulleys 60 and other idler pulleys 62.

Figure 6:
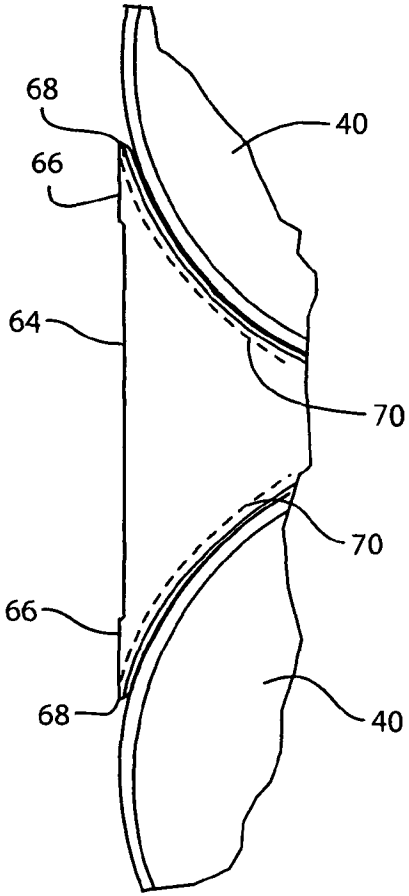
FIG. 6 is a sectional view taken along line 6-6 of FIG. 5.

Referring now to FIG. 6 a close up of the cutting blades 40 and engagement face 64 of the slide plate 38 is shown. The engagement face 64 includes bumpers 66. It can be seen that the bumpers 66 extend slightly beyond the outer periphery of the cutting blades 40. The bumpers 66 will engage the surface of the core thus preventing the cutting blades from engaging the surface of the core and damaging it. The engagement face 64 further includes sharp engagement points 68 which drive into the soft surface of the web material as the cutting head 36 is moving across the surface of the web material and forces the web material into contact with the cutting blades 40. The cutting blades 40 are rotated in a direction determined by the direction of movement of the cutting head so as to provide a "nip" between the cutting blade 40 and the web material as the material crosses the engagement face 64. The slide plate 38 further has grooves 70 located on the interior surface proximate the cutting blades 40 which envelop the outer edge of each cutting blade 40. The grooves 70 allow material to be lifted off of the core and be cut by the blade 40, thus preventing the build up of material between the slide plate 38 and the cutting blade 40.

Figure 8:
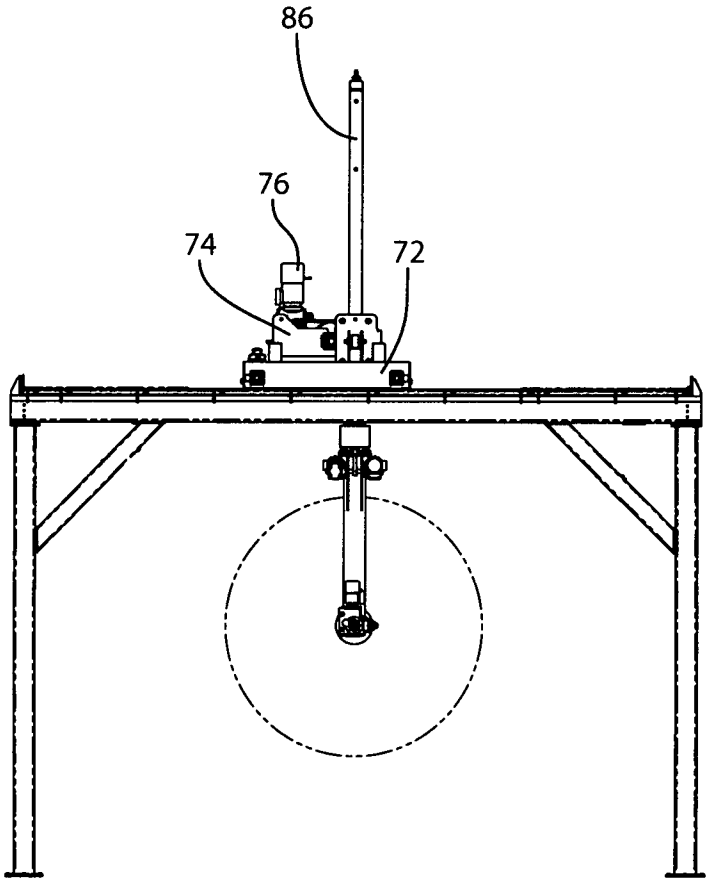
FIG. 8 is a side view of the overhead crane and plugging assembly as used with the present invention.
Figure 9:
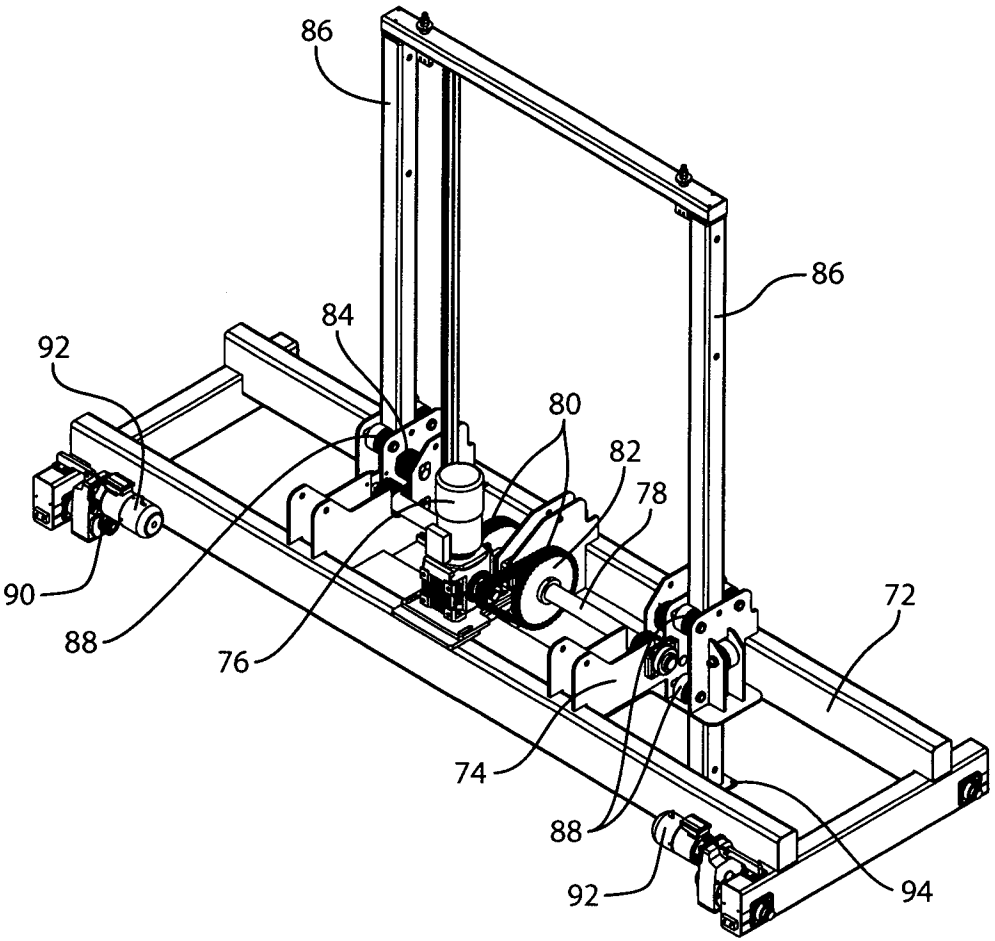
FIG. 9 is a perspective view of the overhead crane as used with the present invention.

Referring now to FIG. 8, the frame 10 of the core cleaning apparatus is shown with the overhead crane and plugging assembly 14 carrying a core roll. Referring now to FIGS. 8 and 9, the overhead crane portion of the overhead crane and plugging assembly 14 is shown in detail. The overhead crane assembly includes a bridge frame 72 which carries a lift drive frame 74. Positioned on the lift drive frame 74 is drive motor 76. The drive motor 76 is engaged with drive shaft 78 through a chain and sprocket 80 combination. The drive shaft 78 in turn is engaged with drive wheels 84 which engage the lift tubes 86. Idler wheels 88 surround opposed sides of the lift tubes 86 to provide stability when the lift tubes 86 are being driven vertically by the drive wheels 84. The bridge frame 72 transverses the top of the apparatus frame 10 by means of drive wheels 90 powered by drive motors 92. Attachment plates 94 are used to attach the lift arms 86 to the spreader bar 96 of the plugging assembly.

Figure 10:
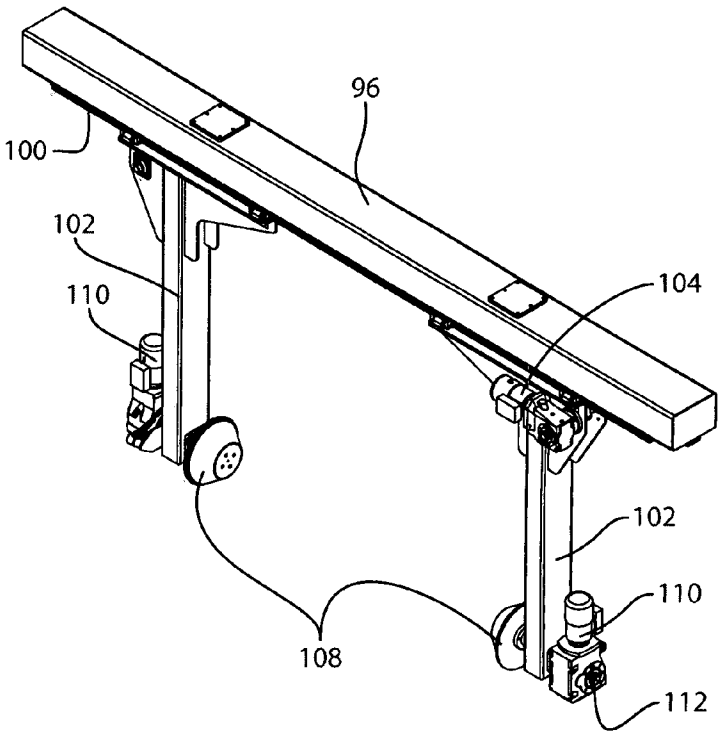
FIG. 10 is a perspective view of the plugging apparatus as used with the present invention.
Figure 11:
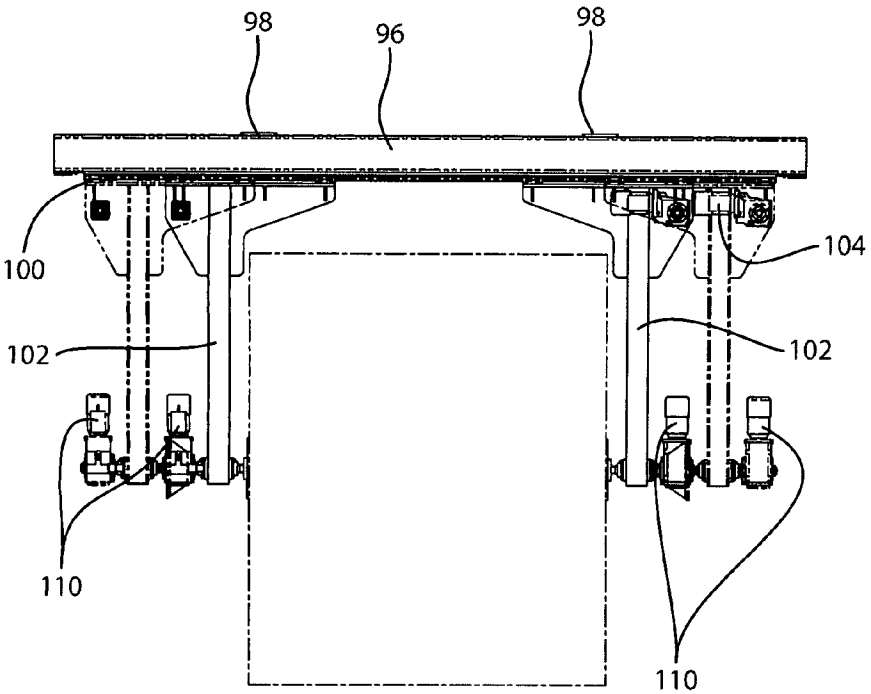
FIG. 11 is a front view of the plugging apparatus of FIG. 10.
Figure 12:
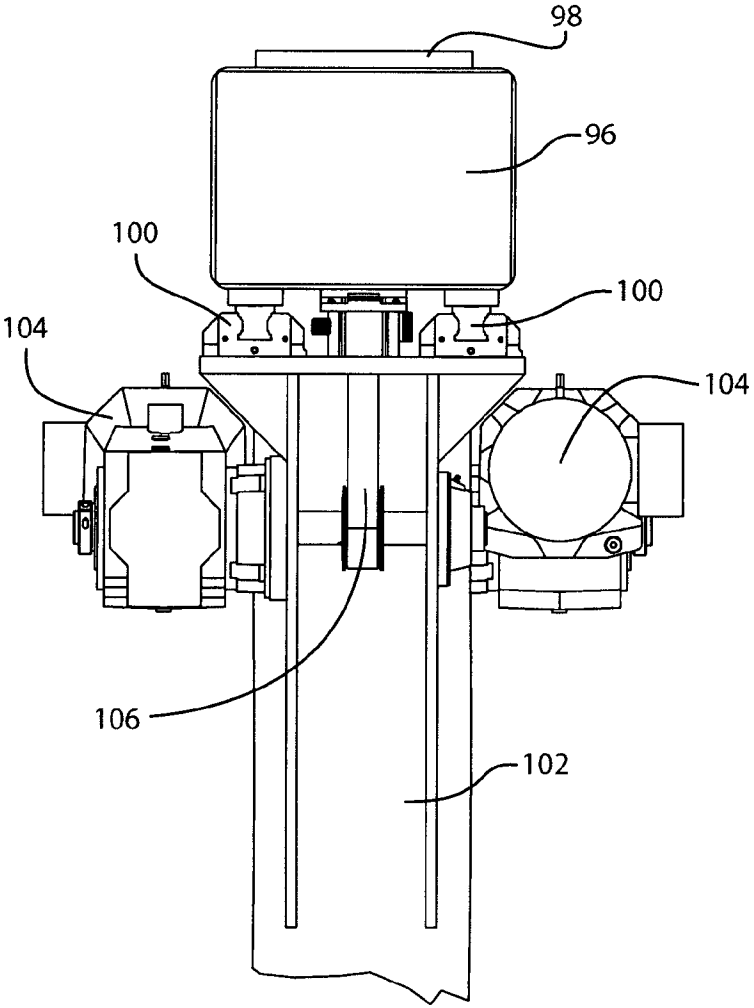
FIG. 12 is a partial side view of the top portion of the plugging apparatus of FIG. 10.

Referring now to FIGS. 10, 11 and 12, the plugging assembly is shown in detail. The plugging assembly includes a spreader bar 96 which is engaged through engagement members 98 with the attachment members 94 of the lift tubes 86. The spreader bar 96 carries a linear rail 100 which extends the length of the spreader bar 96 on its undersurface. Engaged with the linear rail 100 are clamp arms 102. Clamp arms 102 are driven in opposed directions on the spreader bar 96 by means of drive motors 104 and a drive belt 106 combination. Probes 108 are positioned at the bottom of the clamp arms 102 and are engaged with drive motors 110 for rotation about drive shafts 112.

In operation the core cleaning apparatus performs as follows. A used core roll or spent core arrives at the apparatus via a conveyor or other mode of transportation. Information pertaining to the core size and remaining webbing is gathered as the core roll is transferred to the controller. The controller then uses the information to instruct the apparatus in processing the spent core or core roll. This operation is fully automatic. The programmable controller signals the drive motors 104 to space the clamp arms 102 in such a position that the probes 108 are positioned outside the opposed ends of the core (FIG. 11). Drive motor 76 is activated to lower the lift tubes 86 carrying the spreader bar 96 and clamp arms 102 to a position proximate the open ends of the core. The programmable controller then activates the drive motors 104 to move the clamp arms 102 into position proximate the ends of the core, thereby inserting the probes 108 into the core. Drive motor 76 is then activated to raise lift tubes 86 and remove the used core roll from engagement with the conveyor belt or mode of transportation. Drive motors 92 are then activated to motivate drive wheels 90 to move the bridge frame 72 along the apparatus frame 10 until the outside surface of the used core roll or spent core is positioned proximate the cutter assembly 12. The cutting head 36 is positioned to one extreme side of the slide frame 16. The drive motors 92 continue to move the bridge frame until the web material presses into the engagement face 64 of the cutting head. Motor 42 is activated to operate the cutting blades 40 and drive motor 18 is activated to move the engagement face 64 and engagement face points 68 into engagement with the web material as the cutting blades 40 rotate opposite the direction of travel of the cutting head across the face of the web material. After the cutting head 36 has traveled from one end to the other of the core of web material, the drive motors 110 are activated to rotate the probes 108, thereby rotating the used core roll or spent core and dropping the cut web material off of the core. The drive motors 92 are again activated to move the bridge frame 72 closer to the cutter assembly 12 thereby placing remaining web material into engagement with the engagement face 64 of the cutting head. The cutting step is then initiated again. The cutting and rotating steps are continued until the programmable controller senses the outside surface of the core is coming to a point proximate the cutting head 36. The electromagnets 28 are activated to attach to the clamp arms 102, thereby fixing the used core roll in place for one last finishing cut. The pneumatic cylinder is activated to press the engagement face 64 of the cutting head into engagement with the remaining web material. The cutting head is activated for one final finishing cut. The bumpers 66 of the engagement face 64 slide across the surface of the core while the cutting blades 40 operate to remove whatever remaining web material there is. Once the final cut is made on the core, the core is inspected by a camera (not shown) to ensure a clean surface and the lack of any structural damage to the core, such as mushrooming or distortion of the ends of the core. If the core passes inspection, motors 92 will move the bridge frame 72 into position proximate an unloading conveyor and the lift tubes 86 will be lowered by the drive motors 76 until the clean core is placed in the exit conveyor or similar mode of transport.

Of particular note in this invention, the bridge frame 72 can be adjusted in its position every time the drive motors 110 are activated to rotate the probes 108 and drop discarded web material to allow for the discarded web material to accumulate horizontally as well as vertically, thereby allowing for more discarded web material to be placed in an exit conveyor as the exit conveyor is filled up.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. An apparatus for the automatic cleaning of cores designed to carry sheet form material or webbing comprising in combination:

an lift member for engaging the core and vertically lifting the core to different vertical positions;

a horizontally driven member engaged with the lift member for moving the lift member and core horizontally to different horizontal positions;

a cutting member having at least one cutting blade for traveling across the webbing of the core to slice the webbing from the core;

a rotating member engaged with the core for rotating the core during removal of the webbing; and control means for programmably controlling the positioning of the lift member, the horizontally driven member and the cutting member to ensure removal of all excess webbing without damaging the outer surface of the core.

2. The apparatus of claim 1 wherein the at least one cutting blade is capable of rotating in more than one direction, and the direction of rotation of the at least one cutting blade is determined by the direction of travel of the cutting member as the cutting member travels the length of the core.

3. The apparatus of claim 2 wherein the cutting member includes a plurality of cutting blades positioned proximate a slide plate having an engagement face, wherein the engagement face engages the webbing and the cutting blades slice the webbing material for removal.

4. The apparatus of claim 3 wherein operations of the slide plate and the cutting blades lift the webbing from the core while slicing the webbing, thus preventing a buildup of webbing between the slide plate and the cutting blades.

5. The apparatus of claim 1 wherein the lift member includes a pair of clamp arms positioned for movement on a spreader bar wherein the clamp arms are driven into and out of engagement with the ends of the core.

6. The apparatus of claim 5 further including plug members for engaging the ends of the core and drive means for rotating the plug members wherein the plug members are rotated after every slice of the cutting member to drop the cut webbing from the core.

7. The apparatus of claim 1 wherein the horizontally driven member continuously places the webbing into engagement with the cutting member.

8. The apparatus of claim 7 wherein the horizontally driven member incrementally moves as the plug members are being rotated to horizontally layer the discarded web material.

9. The apparatus of claim 3 wherein the engagement face of the slide plate includes bumper portions which engage the surface of the core during the final finishing cut and prevent the cutting blades from cutting or damaging outer surface of the core.

10. The apparatus of claim 5 wherein the cutting member further includes means for engaging the clamp arms to fixedly position the core for the final finishing cut.

11. The apparatus of claim 1 further including a visioning means for inspecting the core to ensure that all excess webbing has been removed and the core is clean.

12. The apparatus of claim 11 wherein the visioning means further inspects the surface of the core, including the ends of the core, for damage.

13. The apparatus of claim 2 wherein the at least one cutting blade is rotated in a direction opposite to the direction of travel of the cutting member as the cutting member travels the length of the core.

14. The apparatus of claim 1 further including a frame wherein the lift member and the horizontal driven member are attached to the frame.

15. The apparatus of claim 14 wherein the lift member is capable of engaging the core anywhere within the frame.

16. The apparatus of claim 2 wherein the cutting member is capable of moving and cutting in more than one direction.

* * * * *